US011565434B2

(12) United States Patent
Paauw et al.

(10) Patent No.: US 11,565,434 B2
(45) Date of Patent: Jan. 31, 2023

(54) SHAVING UNIT HAVING A RETAINING STRUCTURE

(71) Applicant: KONINKLIJKE PHILIPS N.V., Eindhoven (NL)

(72) Inventors: Hendrik Klaas Paauw, Drenthe (NL); Hilde Seip, Groningen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/733,103

(22) PCT Filed: Nov. 9, 2018

(86) PCT No.: PCT/EP2018/080838
§ 371 (c)(1),
(2) Date: May 18, 2020

(87) PCT Pub. No.: WO2019/101548
PCT Pub. Date: May 31, 2019

(65) Prior Publication Data

US 2020/0361103 A1 Nov. 19, 2020

(30) Foreign Application Priority Data

Nov. 21, 2017 (EP) ..... 17202713
Nov. 22, 2017 (EP) ..... 17203036

(51) Int. Cl.
*B26B 19/14* (2006.01)
*B26B 19/38* (2006.01)

(52) U.S. Cl.
CPC ..... *B26B 19/143* (2013.01); *B26B 19/145* (2013.01); *B26B 19/38* (2013.01)

(58) Field of Classification Search
CPC ..... B26B 19/14; B26B 19/141; B26B 19/143; B26B 19/145; B26B 19/146; B26B 19/38
See application file for complete search history.

(56) References Cited

U.S. PATENT DOCUMENTS 3,844,033 A * 10/1974 Yonkers ..... B26B 19/14 30/346.51
3,913,225 A * 10/1975 Tietjens ..... B26B 19/14 30/43.6

(Continued)

FOREIGN PATENT DOCUMENTS

EP 0329244 8/1989
FR 1486702 A * 6/1967 ..... B26B 19/3853

(Continued)

OTHER PUBLICATIONS

International Search Report and Written Opinion dated Mar. 13, 2019 for International Application No. PCT/EP2018/080838 Filed Nov. 9, 2018.

*Primary Examiner* — Jonathan G Riley

(57) ABSTRACT

The invention relates to a shaving unit (11) for use in a shaving device (1). The shaving unit comprises a supporting member (19, 21*a*, 21*b*, 21*c*) and at least two hair cutting units (7*a*, 7*b*, 7*c*) supported by the supporting member. Each hair cutting unit comprises an external cutting member (25*a*) with hair-entry openings (31) and an internal cutting member (27*a*) which is rotatable relative to the external cutting member about an axis of rotation (41) and which has a plurality of hair-cutting elements (35). The shaving unit further comprises a retaining structure (23*a*, 23*b*, 23*c*) which is releasably couplable to the supporting member and which is configured to retain the at least two hair cutting units in an operational position relative to the supporting member in an assembled condition of the shaving unit. The retaining structure comprises, for each respective hair cutting unit of the at least two hair cutting units, a separate retaining member (23*a*, 23*b*, 23*c*) which is releasably couplable to the supporting member and which is configured to separately retain the respective hair cutting unit in an operational position relative to the supporting member independently (Continued)

from any other of the at least two hair cutting units. The retaining structure further comprises, for each respective hair cutting unit of the at least two hair cutting units, a locking member (67) comprising at least one locking element (79*a,* 79*b*) which, in the assembled condition of the shaving unit, is biased by spring force towards the external cutting member of the respective hair cutting unit and engaged by an engagement element (87*a,* 87*b*) of the external cutting member to prevent rotation of the external cutting member about the axis of rotation. The locking member provided for the respective hair cutting unit is separately arranged from any other locking member, provided for any other of the at least two hair cutting units, and integrated with the separate retaining member provided for the respective hair cutting unit.

20 Claims, 5 Drawing Sheets

(56) References Cited

U.S. PATENT DOCUMENTS 4,001,932 A * 1/1977 Herrick ..... B26B 19/14 30/43.5
4,077,120 A 3/1978 Herrick
4,168,570 A * 9/1979 Bakker ..... B26B 19/3846 30/43.6
4,318,223 A 3/1982 Bergsma
7,743,508 B2 * 6/2010 Shimizu ..... B26B 19/14 30/43.6
8,220,157 B2 * 7/2012 Shimizu ..... B26B 19/145 30/43.4
8,230,601 B2 * 7/2012 Shimizu ..... B26B 19/14 30/43.4
8,857,063 B2 * 10/2014 Koike ..... B26B 19/14 30/43.6
10,471,612 B2 * 11/2019 Shimizu ..... B26B 19/146
2006/0260130 A1 * 11/2006 Shimizu ..... B26B 19/14 30/43.6
2007/0089298 A1 * 4/2007 Shimizu ..... B26B 19/145 30/43.6
2010/0018058 A1 * 1/2010 Brada ..... B26B 19/146 30/43.6
2010/0275446 A1 * 11/2010 Schmitt ..... B26B 19/146 30/43.4
2011/0030220 A1 * 2/2011 Shimizu ..... B26B 19/145 30/527
2012/0227266 A1 * 9/2012 Meijer ..... B26B 19/14 30/41.6
2017/0144318 A1 * 5/2017 Van Toor ..... B26B 19/3853
2020/0094424 A1 * 3/2020 Chan ..... B26B 19/145

FOREIGN PATENT DOCUMENTS

WO 2014/020500 2/2014
WO 2015/169625 11/2015
WO WO-2015169625 A1 * 11/2015 ..... B26B 19/14

* cited by examiner

SHAVING UNIT HAVING A RETAINING STRUCTURE

CROSS REFERENCE TO RELATED APPLICATIONS

This application is the U.S. National Phase application under 35 U.S.C. § 371 of International Application No. PCT/EP2018/080838 filed Nov. 9, 2018, published as WO 2019/101548 on May 31, 2019, which claims the benefit of European Patent Application Number 17202713.8 filed Nov. 21, 2017 and European Patent Application Number 17203036.3 filed Nov. 22, 2017. These applications are hereby incorporated by reference herein.

FIELD OF THE INVENTION

The invention relates to a shaving unit for use in a shaving device, said shaving unit comprising a supporting member and at least two hair cutting units supported by the supporting member, wherein each hair cutting unit comprises an external cutting member with hair-entry openings and an internal cutting member which is rotatable relative to the external cutting member about an axis of rotation and which has a plurality of hair-cutting elements, wherein the shaving unit further comprises a retaining structure which is releasably couplable to the supporting member and which is configured to retain the at least two hair cutting units in an operational position relative to the supporting member in an assembled condition of the shaving unit, and wherein the retaining structure comprises, for each respective hair cutting unit of the at least two hair cutting units, a locking member comprising at least one locking element which, in the assembled condition of the shaving unit, is biased by spring force towards the external cutting member of the respective hair cutting unit and engaged by an engagement element of the external cutting member to prevent rotation of the external cutting member about the axis of rotation.

The invention further relates to a shaving head comprising a base structure including a coupling member configured to releasably couple the shaving head to a main body of a shaving device, and a shaving unit of the type mentioned in the opening paragraph which is releasably couplable to the base structure.

The invention further relates to a shaving device comprising a main body accommodating an actuator and a shaving head of the type mentioned here before which is releasably couplable to the main body for being driven by the actuator.

BACKGROUND OF THE INVENTION

Shaving units having two or more hair cutting units, each comprising an external cutting member with hair entry openings and an internal cutting member which is rotatable relative to the external cutting member, are well known. In such shaving units the internal cutting member is usually urged into contact with the external cutting member, for example by a drive spindle driving the internal cutting member into rotation, to enable the cooperation of the external and internal cutting members to effectively cut hairs. To prevent rotation of the external cutting member relative to the supporting member for the hair cutting units under the influence of friction and hair-cutting forces exerted by the rotating internal cutting member, known shaving units comprise a locking structure to prevent such rotation. Known locking structures comprise one or more protrusions provided on the supporting member that, in the operational position of the hair cutting unit relative to the supporting member, engage a corresponding number of indentations provided in a circumferential flange of the external cutting member. Such a locking structure causes difficulties for the user when assembling the shaving unit, for example after cleaning. When assembling the shaving unit, the user has to precisely align said indentations relative to said protrusions before coupling the retaining structure to the supporting member. When the user fails to do so, the shaving unit may be damaged during assembly or afterwards during use, or the shaving unit may not function optimally, as a result of an oblique position of the external cutting members relative to the supporting member.

The above mentioned problem has been partially resolved by a shaving unit of the type mentioned in the opening paragraph, which is known from U.S. Pat. No. 4,318,223. This known shaving unit comprises three hair cutting units supported by a supporting member. Rotation of the external cutting members relative to the supporting member is prevented by locking elements which, in the operational position of the hair cutting units, are biased by spring force towards the external cutting members and engage indentations provided in the circumferential flanges of the external cutting members. The known shaving unit comprises a single common retaining member which is releasably couplable to the supporting member to retain all three hair cutting units in their operational positions relative to the supporting member. The locking elements are integrally formed on a single polygonal frame of a resilient sheet material which is fastened to the common retaining member for the hair cutting units. When assembling the shaving unit, the user has to place each external cutting member, with the associated internal cutting member arranged therein, in a respective opening provided in the supporting member. In this step the external cutting members can be placed in an arbitrary rotational position relative to the center lines of said openings, which is convenient for the user. In a next step the user has to couple the common retaining member to the supporting member. When in this step the locking elements are not aligned relative to the indentations of the external cutting members, the locking elements will be biased against the flanges of the external cutting members. When subsequently the shaving unit is activated, the one or more external cutting members, which are not properly aligned relative to the locking elements after coupling of the common retaining member to the supporting member, will be rotated by the friction and hair-cutting forces of the rotating internal cutting members until the locking elements are aligned with and biased into the corresponding indentations, thereby automatically locking the external cutting members against further rotation. A disadvantage of this known shaving unit is that the common retaining member and the single polygonal frame carrying the locking elements fastened to the common retaining member limit the design freedom for the shaving unit, in particular as regards the spatial arrangement of the hair cutting units. As a result, the known shaving unit has a mere planar arrangement of the hair cutting units.

SUMMARY OF THE INVENTION

An object of the present invention is to provide a shaving unit of the type mentioned in the opening paragraph which does not have the disadvantage of the known shaving unit. In particular the object of the present invention is to provide such a shaving unit with an increased design freedom as regards the spatial arrangement of the hair cutting units, while providing a similar or even an improved ease of use for the user during assembly of the shaving unit as compared with the known shaving unit.

In order to achieve said object, according to the invention a shaving unit of the type mentioned in the opening paragraph is characterized in that the retaining structure comprises, for each respective hair cutting unit of the at least two hair cutting units, a separate retaining member which is releasably couplable to the supporting member and which is configured to separately retain the respective hair cutting unit in an operational position relative to the supporting member independently from any other of the at least two hair cutting units, wherein the locking member provided for the respective hair cutting unit is separately arranged from any other locking member, provided for any other of the at least two hair cutting units, and integrated with the separate retaining member provided for the respective hair cutting unit. In the assembled condition of the shaving unit according to the invention, each hair cutting unit is retained in its operational position relative to the supporting member by a separate retaining member which is individually and releasably coupled to the supporting member independently from the other hair cutting units. The locking member, which comprises one or more locking elements biased by spring force towards the external cutting member and engaged by the external cutting member to prevent rotation thereof, is integrated with the separate retaining member and, as a consequence, separately arranged from the locking members provided for the other hair cutting units. This composition provides a large design freedom as regards the spatial arrangement of the separate retaining members and the separate locking members, integrated in the retaining members, with respect to the supporting member. As a result, said composition also provides a large design freedom as regards the shape of the supporting member and, consequently, the spatial arrangement of the hair cutting units supported by the supporting member. The supporting member may, for example, have a strongly curved shape, for example the shape of part of a sphere. On the other hand, the separate locking members provide at least a similar degree of user comfort as compared with the shaving unit of U.S. Pat. No. 4,318,223 during assembly of the shaving unit, in that the user can place the external cutting members in arbitrary rotational positions in the corresponding openings of the supporting members. The ease of use is even increased, because the mutually separate arrangement of the locking members integrated into the separate retaining members enables the user to remove and place back the hair cutting units one by one from and into the supporting member by separately releasing the separate retaining members and the locking members integrated therein. In an embodiment of a shaving unit according to the invention, the supporting member comprises a base member and, for each respective hair cutting unit of the at least two hair cutting units, a separate supporting element which is pivotally supported by the base member, wherein the separate retaining member provided for the respective hair cutting unit is releasably couplable to the supporting element provided for the respective hair cutting unit to retain the respective hair cutting unit in the operational position. The mutually separate arrangement of the locking members integrated into the separate retaining members allows the separate retaining members with the separate locking members integrated therein to be individually coupled to and pivotal with the separate supporting elements. The separate supporting elements allow the hair cutting units to individually and independently pivot relative to the base member of the supporting member, so that the orientations of the hair cutting units can be individually adapted to the local contours of the skin in contact with the hair cutting units.

In a further embodiment of a shaving unit according to the invention, the engagement element comprises an indentation provided in a circumferential flange of the external cutting member. The indentation provides a simple and reliable interaction with the biased locking element.

In a preferred embodiment of a shaving unit according to the invention, the supporting member comprises, for each respective one of the separate retaining members, a coupling structure configured to enable coupling of the respective separate retaining member to the supporting member by a rotational motion of the separate retaining member relative to the supporting member about the axis of rotation of the respective hair cutting unit. In this embodiment, the separate retaining member for the hair cutting unit is coupled to the supporting member by a rotational motion about the axis of rotation of the hair cutting unit. For this purpose the coupling structure may for example comprise a bayonet coupling. As a result of the rotational motion of the separate retaining member during the coupling step, the locking element integrated into the retaining member may be aligned with and, consequently, biased into engagement with the engagement element of the external cutting member in case the locking element is not already aligned and engaged with the engagement element after placing the retaining member on the supporting member before the coupling step. Thus, this embodiment may provide an automatic locking of the external cutting member against rotation already during assembly of the shaving unit by the user.

In a further embodiment of a shaving unit according to the invention, the locking member comprises a spring member which is fastened to a base portion of the separate retaining member, and the at least one locking element is mounted to the spring member. This embodiment provides a simple structure and integration of the separate locking members into the separate retaining members.

In a still further embodiment of a shaving unit according to the invention, the base portion is mainly annular and the spring member is semi annular having a central portion and two end portions, wherein the locking element is mounted to the central portion of the spring member, and wherein the two end portions of the spring member are mounted to the base portion of the separate retaining member. This embodiment provides a robust structure of the spring member of the locking member, a relatively large biasing force on the locking element, and a relatively large motion path for the locking element in the biasing direction.

In a yet further embodiment of a shaving unit according to the invention comprising the semi-annular spring member, in the assembled condition of the shaving unit the spring member is arranged at a side of the base portion facing away from the external cutting member. In this embodiment, in the assembled condition of the shaving unit the semi-annular spring member may rest against said side of the base portion of the separate retaining member, so that the locking element mounted to the central portion of the spring member has a well-defined position in the biasing direction relative to the engagement element of the external cutting member. The arrangement of the semi-annular spring member at said side of the base portion further enables the spring member to deform to a sufficient degree when, during assembly of the shaving unit by the user, the locking element does not immediately engage the engagement element of the external cutting member.

In a further preferred embodiment of a shaving unit according to the invention, the base portion is mainly annular and the locking member comprises two semi-annular spring members and two locking elements, wherein each locking element is mounted to a central portion of a respective one of the two spring members, and wherein each spring member has two end portions mounted to the base portion of the separate retaining member. In this embodiment, two locking elements are provided for preventing rotation of the external cutting member, whereby the locking function of the separate locking member is improved. The two semi-annular spring members may be provided in an annular configuration on a side of the annular base portion, thereby providing a robust structure of the separate locking member, a relatively large biasing force on the locking elements, and a relatively large motion path for the locking elements in the biasing direction.

In a yet further preferred embodiment of a shaving unit according to the invention, the two locking elements and the two semi-annular spring members of the locking member are integrally formed from a single metal blade. In this way, the separate locking member can be manufactured in a simple manner from a single metal blade, for example by means of a metal cutting and bending process, and can be mounted to the separate retaining member in a simple way, for example by further bending a portion of the metal blade around a mounting element integrally provided on the separate retaining member.

In a further embodiment of a shaving unit according to the invention, the spring member is arranged in a recessed chamber provided in the base portion at a side of the base portion which faces the external cutting member in the assembled condition of the shaving unit. In this embodiment the recessed chamber enables the spring member to deform to a sufficient degree when, during assembly of the shaving unit, the locking element does not immediately engage the engagement element of the external cutting member.

Furthermore, according to the invention, a shaving head of the type mentioned in the opening paragraphs is characterized in that the shaving unit used therein is a shaving unit according to the invention as described here before.

Furthermore, according to the invention, a shaving device of the type mentioned in the opening paragraphs is characterized in that the shaving head used therein is a shaving head according to the invention as described here before.

BRIEF DESCRIPTION OF THE DRAWINGS

For a better understanding of the invention, and to show more clearly how it may be carried into effect, reference will now be made, by way of example only, to the accompanying drawings, in which.

DETAILED DESCRIPTION OF THE EMBODIMENTS

Figure 1:
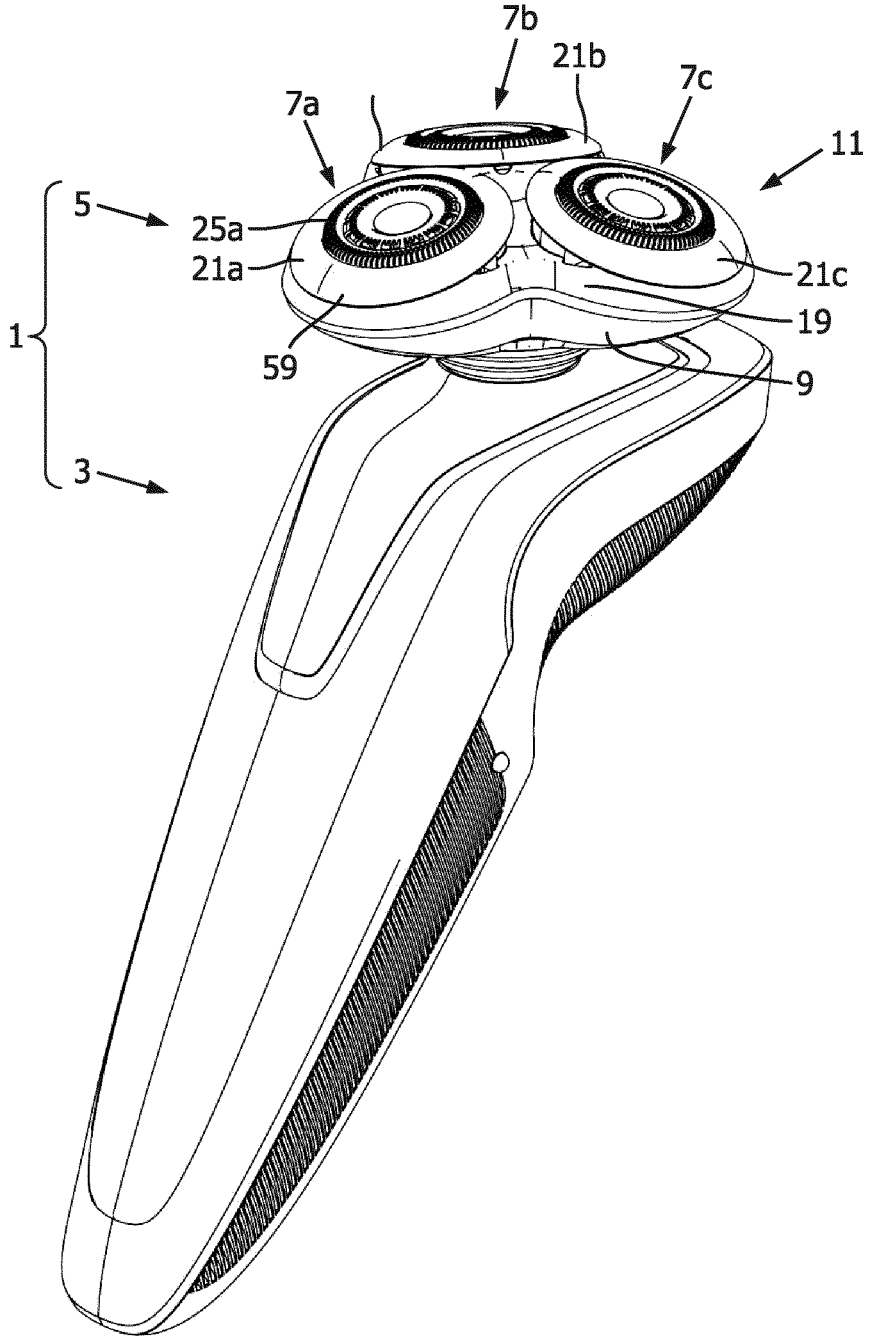
FIG. 1 shows an embodiment of a shaving device according to the invention.

FIG. 1 shows an embodiment of a shaving device 1 according to the invention. The shaving device 1 comprises a main body 3 and a shaving head 5 according to the invention. The main body 3 accommodates an actuator, not visible in FIG. 1, for example an electric motor. The shaving head 5 is releasably couplable to the main body 3 and comprises three hair cutting units 7*a*, 7*b*, 7*c*. In a condition shown in FIG. 1, wherein the shaving head 5 is coupled to the main body 3, the hair cutting units 7*a*, 7*b*, 7*c* can be driven by the actuator when the shaving device 1 is activated by a user.

Figure 2:
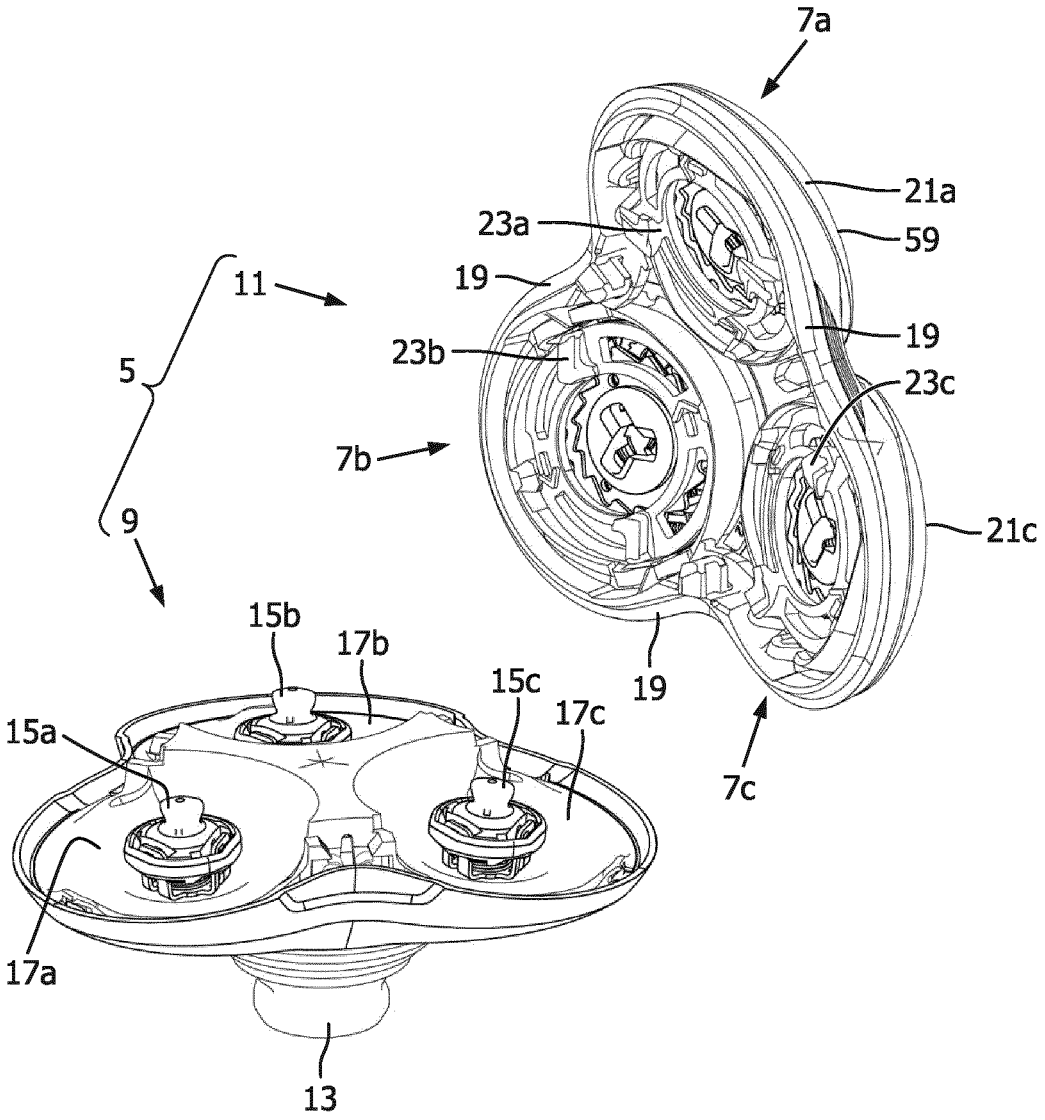
FIG. 2 shows an embodiment of a shaving head according to the invention used in the shaving device of FIG. 1 and comprising a shaving unit according to the invention.

The shaving head 5 is shown in more detail in FIG. 2. The shaving head 5 comprises a base structure 9 and a shaving unit 11 according to the invention. The base structure 9 comprises a coupling member 13 configured to releasably couple the shaving head 5 to the main body 3 of the shaving device 1. The coupling member 13 is only schematically shown in FIG. 2 and may comprise a mechanical snap connector for engagement with a co-operating snap connector provided on the main body 3. Such a snap connector is well known to the skilled person. The shaving unit 11 is releasably couplable to the base structure 9 of the shaving head 5. FIG. 1 shows the shaving head 5 in an operational condition wherein the shaving unit 11 is coupled to the base structure 9. FIG. 2 shows the shaving head 5 in a condition wherein the shaving unit 11 is separated from the base structure 9. The base structure 9 and the shaving unit 11 may be provided with any suitable co-operating coupling elements, not shown in FIG. 2, for releasable coupling of the shaving unit 11 to the base structure 9, for example co-operating mechanical snap connectors which are well known to the skilled person.

As further shown in FIG. 2, the base structure 9 comprises three rotatable drive spindles 15*a*, 15*b*, 15*c*, each for rotatably driving a respective one of the three hair cutting units 7*a*, 7*b*, 7*c* when the shaving unit 11 is coupled to the base structure 9. The drive spindles 15*a*, 15*b*, 15*c* can be driven by the actuator in the main body 3, via a suitable transmission mechanism arranged in the base structure 9 and not visible in FIG. 2, when the shaving head 5 is coupled to the main body 3. The base structure 9 further comprises three hair collecting chambers 17*a*, 17*b*, 17*c* for collecting hairs cut by the hair cutting units 7*a*, 7*b*, 7*c* when the shaving unit 11 is coupled to the base structure 9.

The shaving unit 11 comprises a supporting member and further comprises the three hair cutting units 7*a*, 7*b*, 7*c* which are supported by the supporting member in an assembled condition of the shaving unit 11 as shown in FIG. 2. In alternative embodiments the shaving unit according to the invention may comprise a different number of hair cutting units, for example two hair cutting units or more than three hair cutting units. The supporting member of the shaving unit 11 comprises a base member 19 and, for each of the three hair cutting units 7*a*, 7*b*, 7*c*, a separate supporting element 21*a*, 21*b*, 21*c*. As shown in FIG. 1 and FIG. 2 the base member 19 is a supporting frame provided with three openings wherein the supporting elements 21*a*, 21*b*, 21*c* are arranged. The base member 19 also comprises the coupling elements for releasable coupling of the shaving unit 11 to the base structure 9 of the shaving head 5.

Figure 3:
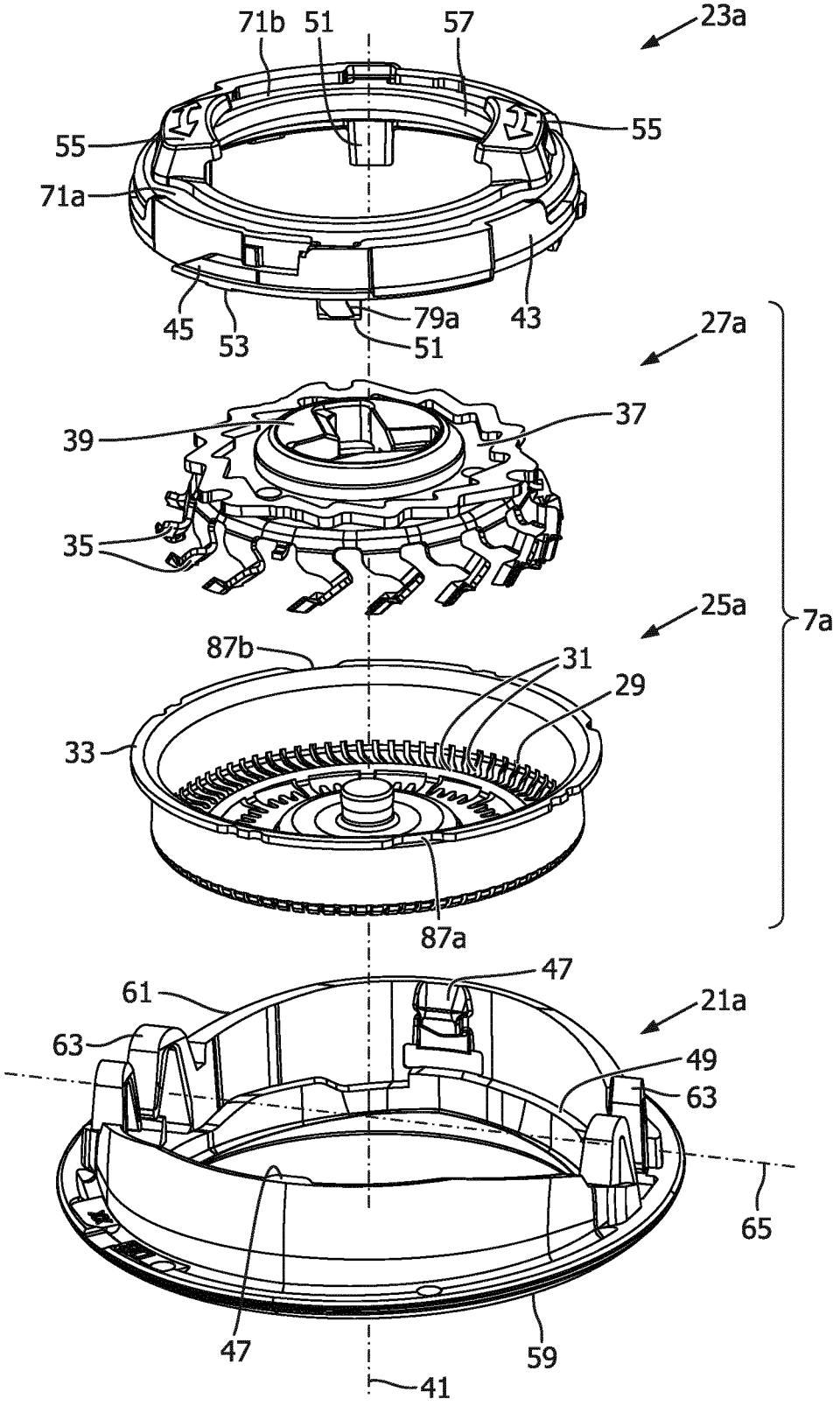
FIG. 3 shows a supporting element, a hair cutting unit and a retaining member of the shaving unit shown in FIG. 2.

FIG. 3 shows one of the three supporting elements 21*a* of the shaving unit 11 together with the associated hair cutting unit 7*a* and an associated retaining member 23*a* in a mutually disassembled condition. The hair cutting unit 7*a* comprises an external cutting member 25*a* and an internal cutting member 27*a*. The external cutting member 25*a* is generally in the form of a cylindrical cap having an annular shaving track 29 wherein a plurality of hair-entry openings 31 is provided. The external cutting member 25*a* further comprises a circumferential flange 33 provided at a side of the cap remote from the shaving track 29. The internal cutting member 27*a* has a plurality of hair-cutting elements 35 which are provided in an annular configuration on a carrying member 37 of the internal cutting member 27*a*. The carrying member 37 has a central coupling cavity 39 for receiving the associated drive spindle 15*a* in the assembled condition of the shaving head 5. In said assembled condition the internal cutting member 27*a* is rotatable relative to the external cutting member 25*a* about an axis of rotation 41 by means of the drive spindle 15*a*. During rotation of the internal cutting member 27*a* relative to the external cutting member 25*a*, hairs that penetrate through the hair-entry openings 31 of the external cutting member 25*a* are cut by interaction between cutting edges provided on the hair-cutting elements 35 of the internal cutting member 27*a* and counter cutting edges provided on side walls of the hair-entry openings 31 of the external cutting member 25*a*. It is noted that, similar to the hair cutting unit 7*a*, the hair cutting units 7*b* and 7*c* each comprise an external cutting member and an internal cutting member similar to, respectively, the external cutting member 25*a* and the internal cutting member 27*a*.

The retaining member 23*a* comprises a mainly annular base portion 43 which is releasably couplable to the supporting element 21*a* to retain the hair cutting unit 7*a* in an operational position relative to the supporting element 21*a* in the assembled condition of the shaving unit 11. For this purpose the retaining member 23*a* comprises two bayonet-type coupling elements 45 which are provided in two diametrically opposite circumferential positions on the annular base portion 43. Only one of the two bayonet-type coupling elements 45 is visible in FIG. 3. The bayonet-type coupling elements 45 are configured to co-operate with and engage two coupling protrusions 47 which are provided in two diametrically opposite positions on an inner wall of the supporting element 21*a*. To bring and retain the hair cutting unit 7*a* in its operational position relative to the supporting element 21*a* starting from the disassembled condition shown in FIG. 3, the user has to place the internal cutting member 27*a* into the external cutting member 25*a* such that the hair-cutting elements 35 contact the annular shaving track 29. Subsequently the user has to place the shaving unit 7*a* into the supporting element 21*a*, whereby the circumferential flange 33 of the external cutting member 25*a* abuts an annular internal rim 49 provided on the inner wall of the supporting element 21*a*. Finally the user has to couple the retaining member 23*a* to the supporting element 21*a* by placing the retaining member 23*a* on the circumferential flange 33 of the external cutting member 25*a* and bringing the two bayonet-type coupling elements 45 of the retaining member 23*a* into engagement with the two coupling protrusions 47 of the supporting element 21*a*. To assist the user in correctly aligning the retaining member 23*a* relative to the external cutting member 25*a*, the retaining member 23*a* comprises two aligning elements 51 provided in two diametrically opposite positions on the annuler base portion 43 for contacting an inner wall of the cap of the external cutting member 25*a*. The bayonet-type coupling elements 45 and the coupling protrusions 47 are brought into mutual engagement via a rotational motion of the retaining member 23*a* relative to the supporting member 21*a* about the axis of rotation 41. As a result the circumferential flange 33 is locked in a direction parallel to the axis of rotation 41 between the annular internal rim 49 of the supporting element 21*a* and an annular abutment surface 53 of the base portion 43 of the retaining member 23*a*. The rotation of the retaining member 23*a* by the user is facilitated by two finger-grip portions 55 which are provided on a side of the base portion 43 remote from the abutment surface 53. With the retaining member 23*a* thus coupled to the supporting element 21*a* as shown in FIG. 2, the internal cutting member 27*a* is held in position in the external cutting member 25*a* with some play in the direction parallel to the axis of rotation 41 by means of an internal annular flange 57 provided on the base portion 43 of the retaining member 23*a*. When subsequently the shaving unit 11 is coupled to the base structure 9 of the shaving head 5, the hair-cutting elements 35 of the internal cutting member 27*a* will be urged into operational contact with the shaving track 29 of the external cutting member 25*a* by the drive spindle 15*a*.

It is noted that the shaving unit 11 comprises a separate retaining member 23*b*, 23*c*, similar to the retaining member 23*a*, for each of the other hair cutting units 7*b*, 7*c*, which is releasably couplable to the respective supporting element 21*b*, 21*c* in a manner similar to the retaining member 23*a*. Thereby, each of the three hair cutting units 7*a*, 7*b*, 7*c* is separately retained in its operational position relative to the respective supporting element 21*a*, 21*b*, 21*c* independently from any other of the hair cutting units 7*a*, 7*b*, 7*c*. As a result, in the condition of the shaving head 5 as shown in FIG. 2, each retaining member 23*a*, 23*b*, 23*c* can be separately released from its associated supporting element 21*a*, 21*b*, 21*c*, so that each of the hair cutting units 7*a*, 7*b*, 7*c* can be separately released from the associated supporting member 21*a*, 21*b*, 21*c*. The retaining members 23*a*, 23*b*, 23*c* together form a retaining structure of the shaving unit 11 which is releasably couplable to the supporting member of the shaving unit 11 to retain the three hair cutting units 7*a*, 7*b*, 7*c* in an operational position relative to the supporting member in the assembled condition of the shaving unit 11.

The supporting element 21*a* comprises a skin contacting surface 59, visible in FIG. 1, which surrounds the external cutting member 25*a* in the assembled condition of the shaving unit 11. The supporting element 21*a* further comprises a mainly cylindrical receiving member 61, visible in FIG. 3, for receiving and accommodating the external cutting member 25*a* in the assembled condition of the shaving unit 11. The supporting element 21*a* is pivotally supported by the base member 19 of the shaving unit 11. For this purpose the supporting element 21*a* comprises two pivot members 63 which are arranged in two diametrically opposite positions on the supporting element 21*a*. The two pivot members 63 engage two co-operating pivot members, not visible in the figures, which are provided near the opening in the base member 19 wherein the supporting element 21*a* is arranged. By means of the pivot members 63 the supporting element 21*a* is pivotal relative to the base member 19, together with the hair cutting unit 7*a*, about a pivot axis 65 defined by the positions of the two co-operating pivot members provided on the base member 19. It is noted that the other supporting elements 21*b*, 21*c* are similar to the supporting element 21*a*, so that each supporting element 21*a*, 21*b*, 21*c* is individually pivotal relative to the base member 19 independently of any other of the supporting elements 21*a*, 21*b*, 21*c*. Thus, when the shaving unit 11 is used on a curved skin surface, the orientations of the hair cutting units 7*a*, 7*b*, 7*c* relative to the base member 19 can be individually adapted to local skin contours, so that the hair cutting units 7*a*, 7*b*, 7*c* will remain in optimum contact with the skin.

In an alternative embodiment of the shaving unit according to the invention, not shown in the figures, the supporting elements 21*a*, 21*b*, 21*c* are omitted and the supporting member of the shaving unit merely comprises a common base member for supporting the hair cutting units. In this alternative embodiment, similar to the embodiment shown in FIG. 1, the retaining structure comprises a separate retaining member for each respective hair cutting unit. The retaining members however are each releasably couplable to the base member, so that in the assembled condition of the shaving unit the hair cutting units 7*a*, 7*b*, 7*c* merely have a mainly static operational position relative to the base member. The base member comprises, for each retaining member, a coupling structure enabling releasable coupling of the respective retaining member to the base member. Said coupling structure may comprise two coupling protrusions, similar to the coupling protrusions 47, provided on the base member for co-operation with two bayonet-type coupling elements, similar to the bayonet-type coupling elements 45, provided on the respective retaining member.

Figure 4A:
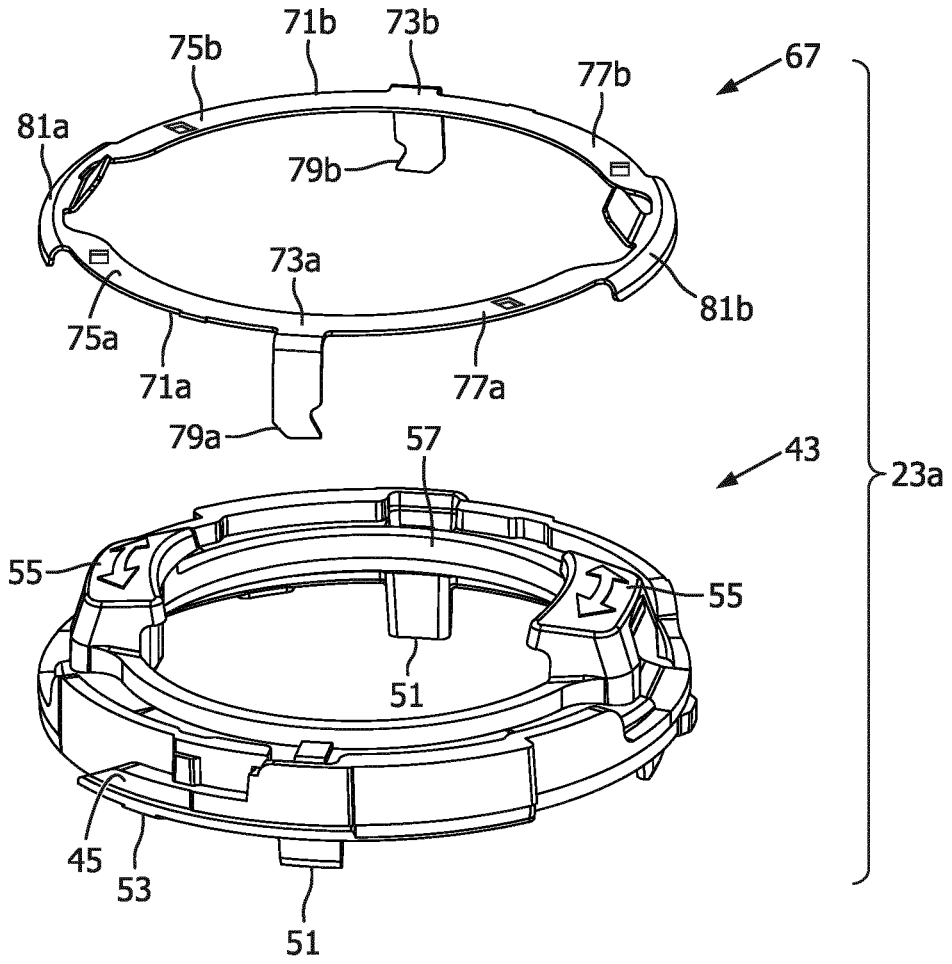
FIG. 4A shows the retaining member of FIG. 3 in detail, wherein a base portion and a locking member of the retaining member are separately shown.
Figure 4B:
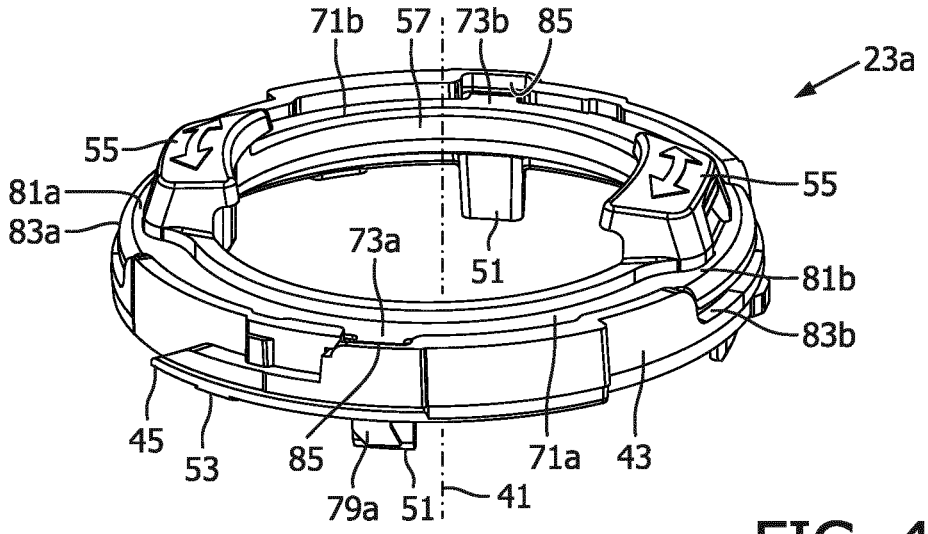
FIG. 4B shows the retaining member of FIG. 3 with the locking member integrated therein.

During operation of the shaving unit 11 the rotating internal cutting member 27*a* exerts a friction force on the external cutting member 25*a*. Furthermore, as a result of the cooperation between the internal cutting member 27*a* and the external cutting member 25*a* in cutting hairs, the rotating internal cutting member 27*a* exerts hair-cutting related forces on the external cutting member 25*a* during operation of the shaving unit 11. These friction and hair-cutting related forces induce a mechanical torque about the axis of rotation 41 exerted on the external cutting member 25*a*. To prevent rotation of the external cutting member 25*a* about the axis of rotation 41 under the influence of said mechanical torque during normal operation, the retaining structure of the shaving unit 11 comprises, for each hair cutting unit 7*a*, 7*b*, 7*c*, a locking member 67. FIG. 4A shows the retaining member 23*a* provided for the hair cutting unit 7*a* as shown in FIG. 3, wherein the base portion 43 and the locking member 67 are separately shown. FIG. 4B shows the retaining member 23*a* with the locking member 67 integrated therein. The retaining members 23*b* and 23*c* provided for, respectively, the hair cutting unit 7*b* and the hair cutting unit 7*c* each have a similar locking member 67 integrally arranged therein. Thus, in accordance with the invention, the locking member 67 provided for each respective one of the hair cutting units 7*a*, 7*b*, 7*c* is separately arranged from any other locking member 67 provided for any other of the hair cutting units 7*a*, 7*b*, 7*c* and integrated with the associated separate retaining member 23*a*, 23*b*, 23*c* provided for the respective one of the hair cutting units 7*a*, 7*b*, 7*c*.

As shown in FIG. 4A and FIG. 4B, the locking member 67 comprises two semi-annular spring members 71*a*, 71*b*. Each spring member 71*a*, 71*b* has a central portion 73*a*, 73*b* and two end portions 75*a*, 77*a*; 75*b*, 77*b*. The locking member 67 further comprises two locking elements 79*a*, 79*b*. The locking element 79*a* is mounted to the central portion 73*a* of the spring member 71*a* and the locking element 79*b* is mounted to the central portion 73*b* of the spring member 71*b*. The two locking elements 79*a*, 79*b* and the two semi-annular spring members 71*a*, 71*b* are integrally formed from a single metal blade by suitable metal cutting and bending processes. The end portion 75*a* of the spring member 71*a* and the end portion 75*b* of the spring member 71*b* are mutually connected via a first mounting portion 81*a*. The end portion 77*a* of the spring member 71*a* and the end portion 77*b* of the spring member 71*b* are mutually connected via a second mounting portion 81*b*. The first and second mounting portions 81*a*, 81*b* are also integrally formed on the locking member 67 from said single metal blade. As shown in FIG. 4B, the first and second mounting portions 81*a*, 81*b* are each connected to a respective one of two mounting elements 83*a*, 83*b* which are integrally provided in two diametrically opposite positions on the annular base portion 43. The connection of the first and second mounting portions 81*a*, 81*b* to the mounting elements 83*a*, 83*b* may be established by a suitable metal bending process. Thus, the two end portions 75*a*, 77*a*; 75*b*, 77*b* of the spring members 71*a*, 71*b* are mounted to the base portion 43 via the first and second mounting portions 81*a*, 81*b*, while the central portions 73*a*, 73*b* of the spring members 71*a*, 71*b* are free to move away from the base portion 43 in a direction parallel to the axis of rotation 41 by elastic deformation of the spring members 71*a*, 71*b*.

As shown in FIG. 4B the spring members 71*a*, 71*b* are arranged at a side of the base portion 43 opposite to the annular abutment surface 53. As a result, in the assembled condition of the shaving unit 11, the spring members 71*a*, 71*b* are arranged at the side of the base portion 43 facing away from the external cutting member 25*a*. The locking elements 79*a*, 79*b* each extend through a respective one of two openings 85 provided through the base portion 43. In a resting position of the spring members 71*a*, 71*b*, wherein the spring members 71*a*, 71*b* rest against the base portion 43 as shown in FIG. 4B, the locking elements 79*a*, 79*b* each protrude relative to the abutment surface 53 in two diametrically opposite positions. It is noted that in FIG. 4B only the locking element 79*a* is visible, while the locking element 79*b* is hidden behind the aligning element 51 diametrically opposite to the locking element 79*a*.

In the assembled condition of the shaving unit 11, wherein the circumferential flange 33 of the external cutting member 25*a* is retained in the direction parallel to the axis of rotation 41 between the annular internal rim 49 of the supporting element 21*a* and the abutment surface 53 of the base portion 43 of the retaining member 23*a*, the locking elements 79*a*, 79*b* are in their protruding positions as shown in FIG. 4B. In these positions the locking elements 79*a*, 79*b* are biased by spring force of the spring members 71*a*, 71*b* towards the external cutting member 25*a* and into engagement with a respective one of two engagement elements provided on the external cutting member 25*a*. In the embodiment shown in FIG. 3 the two engagement elements are two indentations 87*a*, 87*b* which are provided in two diametrically opposite positions in the circumferential flange 33 of the external cutting member 25*a*. By the mutual engagement of the locking elements 79*a*, 79*b* and the indentations 87*a*, 87*b* in the assembled condition of the shaving unit 11, rotation of the external cutting member 25*a* about the axis of rotation 41 under the influence of friction and hair-cutting related forces exerted by the rotating internal cutting member 27*a* is prevented.

The locking members 67 comprising the resiliently biased locking elements 79*a*, 79*b* integrated in the separate retaining members 23*a*, 23*b*, 23*c* enable a convenient assembly of the shaving unit 11 by the user, for example when the user has removed the hair cutting units 7*a*, 7*b*, 7*c* from the supporting elements 21*a*, 21*b*, 21*c* for cleaning. In particular, when bringing and retaining the hair cutting unit 7*a* in its operational position relative to the supporting element

21*a* starting from the disassembled condition shown in FIG. 3 as described here before, the user is allowed to place the external cutting member 25*a*, with the internal cutting member 27*a* placed therein, in an arbitrary angular position relative to the axis of rotation 41 in the supporting element 21*a* before coupling the retaining member 23*a* to the supporting element 21*a*. In other words, the user doesn't need to align the angular position of the external cutting member 25*a* about the axis of rotation 41 when placing the external cutting member 25*a* in the supporting element 21*a*. When the user subsequently places the retaining member 23*a* on the circumferential flange 33 of the external cutting member 25*a*, the protruding locking elements 79*a*, 79*b* may casually engage the indentations 87*a*, 87*b*. In such a case the external cutting member 25*a* is immediately locked against rotation relative to the retaining member 23*a* and, consequently, will rotate together with the retaining member 23*a*, when the user subsequently rotates the retaining member 23*a*, until the retaining member 23*a* is fully coupled to the supporting element 21*a*. In the most frequent case however, i.e. when during initial placement of the retaining member 23*a* on the flange 33 of the external cutting member 25*a* the locking elements 79*a*, 79*b* will not directly engage the indentations 87*a*, 87*b*, the locking elements 79*a*, 79*b* will abut against the flange 33 of the external cutting member 25*a*. As a result, the locking elements 79*a*, 79*b* will be forced into a recessed position in the openings 85 provided in the base portion 43 under elastic deformation of the central portions 73*a*, 73*b* of the spring members 71*a*, 71*b* away from the base portion 43. When subsequently the user rotates the retaining member 23*a* in order to couple the retaining member 23*a* to the supporting element 21*a*, the locking elements 79*a*, 79*b* may in some cases engage and be urged into the indentations 87*a*, 87*b* by the spring members 71*a*, 71*b* during said rotation of the retaining member 23*a*, as a result of which the external cutting member 25*a* will be locked against rotation relative to the retaining member 23*a*. This will evidently depend on the angular position of the locking elements 79*a*, 79*b* relative to the indentations 87*a*, 87*b* after the initial placement of the retaining member 23*a* on the flange 33 of the external cutting member 25*a* and on the total angular rotation required to couple the retaining member 23*a* to the supporting element 21*a*. When after coupling of the retaining member 23*a* to the supporting element 21*a* the locking elements 79*a*, 79*b* still do not engage the indentations 87*a*, 87*b*, the locking elements 79*a*, 79*b* will engage and be urged into the indentations 87*a*, 87*b* by the spring members 71*a*, 71*b* after activation of the shaving device. In such a case, after activation of the shaving device, the external cutting member 25*a* will initially rotate about the axis of rotation 41 relative to the coupled retaining member 23*a* under the influence of the friction and hair-cutting related forces exerted by the rotating internal cutting member 27*a* until the locking elements 79*a*, 79*b* as yet engage the indentations 87*a*, 87*b*. It will be clear that the assembly of the other hair cutting units 7*b*, 7*c* into the shaving unit 11 will proceed in a similar manner and will provide an automatic locking of the external cutting members thereof against rotation in a similar convenient way. It will also be clear that said assembly including said automatic locking against rotation may be performed by the user for each hair cutting unit 7*a*, 7*b*, 7*c* separately and independently from any other of the hair cutting units 7*a*, 7*b*, 7*c*.

In an alternative embodiment of the shaving unit according to the invention, the locking member may comprise only a single locking element. The single locking element may be mounted to a single semi-annular spring member similar to the spring member 71*a* described here before. The single semi-annular spring member may have two end portions mounted to the annular base portion of the retaining member and a central portion carrying the single locking element. In further alternative embodiments, the spring member of the locking member carrying the locking element may have a different shape and may be fastened to the base portion in a different way and in a different position as compared to the spring member 71*a* described here before. The spring member and the locking element may be integrally formed with the base portion from a single plastic material, for example by means of an injection molding process. The number of locking elements provided on the locking member may be greater than two.

Figure 5:
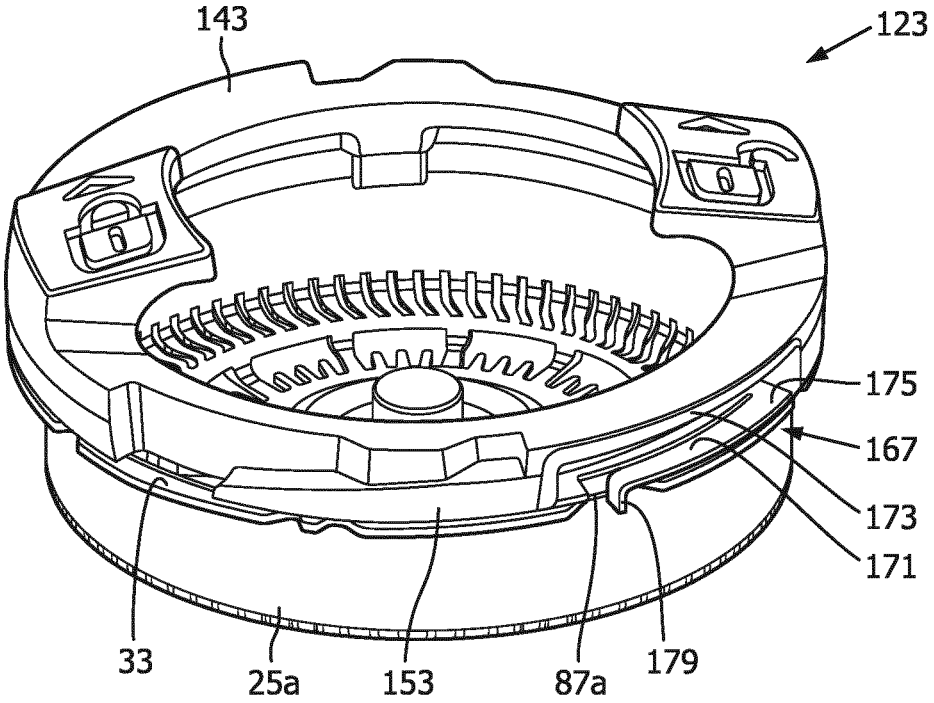
FIG. 5 shows a retaining member of an alternative embodiment of a shaving unit according to the invention.

An example of an alternative embodiment of the shaving unit according to the invention is shown in FIG. 5, which shows in detail an alternative retaining member 123 that may be used in the shaving unit 11 instead of the retaining member 23*a*, 23*b*, 23*c*. The retaining member 123 is shown in an operational position on the circumferential flange 33 of the external cutting member 25*a*. The supporting element and the internal cutting member are not shown in FIG. 5. The retaining member 123 comprises a mainly annular base portion 143 which is substantially similar to the base portion 43 of the retaining member 23*a*, 23*b*, 23*c*. The retaining member 123 comprises a locking member 167 having two blade spring members 171 which are each arranged in a recessed chamber 173 provided in the base portion 143 at a side of the base portion 143 which faces the external cutting member 25*a* in the assembled condition of the shaving unit. In FIG. 5 only one of the blade spring members 171 and only one of the recessed chambers 173 is visible. The other blade spring member and the other recessed chamber are arranged in a diametrically opposite position in the base portion 143. A locking element 179 is formed by a bent end portion of the blade spring member 171. The blade spring member 171 is integrally formed with a metal carrier plate 175 which is mounted in a position substantially flush with the annular abutment surface 153 of the base portion 143. In the operational position shown in FIG. 5 the locking element 179 engages the indentation 87*a* in the flange 33 of the external cutting member 25*a*. When during assembly of the shaving unit, after initial placement of the retaining member 123 on the flange 33 as described here before in relation to the retaining member 23*a*, the locking element 179 does not immediately engage the indentation 87*a*, the locking element 179 will abut the flange 33 and the blade spring member 171 will elastically deform into the recessed chamber 173 allowing a recessed position of the locking element 179 in the recessed chamber 173. The operation of the locking member 167 and the locking elements 179 thereof is similar to the operation of the locking member 67 and the locking elements 79*a*, 79*b* as described here before.

While the invention has been described and illustrated in detail in the foregoing description and in the drawings, such description and illustration are to be considered as exemplary and/or illustrative and not in a limiting sense. The invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. For the purpose of clarity and conciseness of the description, features are disclosed herein as part of the same embodiment or as part of separate embodiments, however, it will be appreciated that the scope of the invention may include embodiments having combinations of all or some of the features disclosed. The mere fact that certain measures are recited in mutually different dependent claims does not indicate that a combination of these measures cannot be used to advantage.

The invention claimed is:

1. A shaving unit for use in a shaving device, said shaving unit comprising a base member and at least two hair cutting units, wherein each hair cutting unit includes:

a support element supported by the base member;

an external cutting member with hair-entry openings;

an internal cutting member with a plurality of hair-cutting elements, wherein the external cutting member and the internal cutting member are in an operational position within the support element, and wherein, in the operational position within the support element, the internal cutting member is rotatable relative to the external cutting member about an axis of rotation; and a retaining member including:

a base portion releasably coupled to the support element and which is configured to retain the external cutting member and the internal cutting member in the operational position within the support element; and a locking member fastened to the base portion, wherein the locking member includes a spring member and a locking element, wherein the locking element (i) is integrally formed with the spring member at a central portion of the spring member and (ii) extends from the central portion of the spring member in a direction towards the external cutting member, wherein the locking element is biased in the direction towards the external cutting member via the spring member and configured to engage an engagement element of the external cutting member and lock the external cutting member against rotation relative to the retaining member, subsequent to (i) an initial placement of the external cutting member in an arbitrary angular position relative to the axis of rotation into the support element, and (ii) a releasable coupling of the base portion of the retaining member to the support element.

2. The shaving unit as claimed in claim 1, wherein each support element is pivotally supported by the base member.

3. The shaving unit as claimed in claim 1, wherein the engagement element includes an indentation provided in a circumferential flange of the external cutting member; and wherein the locking element of the locking member is engaged by the indentation.

4. The shaving unit as claimed in claim 2, wherein the support element and the retaining member include a coupling structure releasably coupling the retaining member to the support element by a rotational motion of the retaining member relative to the support element about the respective axis of rotation.

5. The shaving unit as claimed in claim 1, wherein the locking member further includes mounting portions integrally formed with the spring member, wherein the spring member is fastened to the base portion via the mounting portions being connected with mounting elements provided on the base portion, and wherein the spring member is free to move away from the base portion in a direction parallel to the axis of rotation by elastic deformation of the spring member.

6. The shaving unit as claimed in claim 5, wherein the base portion is annular; and wherein the spring member is semi annular and fastened to the base portion via the mounting portions, wherein the mounting portions are located at opposite end portions of the semi annular spring member.

7. The shaving unit as claimed in claim 5, wherein the base portion is arranged between the spring member and the external cutting member.

8. The shaving unit as claimed in claim 5, wherein the base portion is annular; and wherein the spring member is an annular configuration of two semi-annular spring members.

9. The shaving unit as claimed in claim 5, wherein the spring member and the at least one locking element are integrally formed from a single metal blade.

10. The shaving unit as claimed in claim 5, wherein the spring member is arranged between the base portion and the external cutting member.

11. A shaving head, comprising:

a base structure including a coupling member configured to releasably couple the shaving head to a main body of a shaving device; and a shaving unit which is releasably couplable to the base structure, wherein the shaving unit is a shaving unit according to claim 1.

12. A shaving device, comprising:

a main body; and a shaving head which is releasably couplable to the main body, wherein the shaving head is a shaving head according to claim 11.

13. A shaving unit for use in a shaving device, said shaving unit comprising a base member and at least two hair cutting units, wherein each hair cutting unit includes:

a support element supported by the base member;

an external cutting member with hair-entry openings;

an internal cutting member with a plurality of hair-cutting elements, wherein the external cutting member and the internal cutting member are in an operational position within the support element, and wherein, in the operational position within the support element, the internal cutting member is rotatable relative to the external cutting member about an axis of rotation; and a retaining member including:

a base portion releasably coupled to the support element and which is configured to retain the external cutting member and the internal cutting member in the operational position within the support element; and a locking member that comprises a spring member, mounting portions, and a locking element, wherein the locking member is fastened to the base portion via the mounting portions, wherein the mounting portions are integrally formed with the spring member at opposite ends of the spring member, wherein the locking element (i) is integrally formed with the spring member at a central portion of the spring member and (ii) extends from the central portion of the spring member in a direction towards the external cutting member, wherein the locking element is biased in the direction towards the external cutting member via the spring member and configured to engage an engagement element of the external cutting member and lock the external cutting member against rotation relative to the retaining member, subsequent to (i) an initial placement of the external cutting member in an arbitrary angular position relative to the axis of rotation into the support element, and (ii) a releasable coupling of the base portion of the retaining member to the support element.

14. The shaving unit as claimed in claim 13, wherein each support element is pivotally supported by the base member.

15. The shaving unit as claimed in claim 13, wherein the engagement element includes an indentation provided in a circumferential flange of the external cutting member; and wherein the locking element of the locking member is engaged by the indentation.

16. The shaving unit as claimed in claim 13, wherein the support element and the retaining member include a coupling structure releasably coupling the retaining member to the support element by a rotational motion of the retaining member relative to the support element about the respective axis of rotation.

17. The shaving unit as claimed in claim 13, wherein the locking member is fastened to the base portion via the mounting portions further includes wherein the spring member is fastened to the base portion via the mounting portions being connected with mounting elements provided on the base portion, and wherein the spring member is free to move away from the base portion in a direction parallel to the axis of rotation by elastic deformation of the spring member.

18. The shaving unit as claimed in claim 17, wherein the base portion is annular; and wherein the spring member comprises two semi annular spring members, wherein the two semi annular spring members are fastened to the base portion via the mounting portions, wherein the mounting portions are located at opposite end portions of each semi annular spring member.

19. A shaving head, comprising:

a base structure including a coupling member configured to releasably couple the shaving head to a main body of a shaving device; and a shaving unit which is releasably couplable to the base structure, wherein the shaving unit is a shaving unit according to claim 13.

20. A shaving device, comprising:

a main body; and a shaving head which is releasably couplable to the main body, wherein the shaving head is a shaving head according to claim 19.

* * * * *